United States Patent [19]

Barclay et al.

[11] 4,354,675

[45] Oct. 19, 1982

[54] WEIGHT LIFTING DEVICE

[75] Inventors: Stanley B. Barclay, Mississauga; Eugene L. Knaitner, Weston; Eugenio E. Remedios, Georgetown; Arkadi Altosaar, Willowdale; Richard Rusiniak, Mississauga, all of Canada

[73] Assignee: Global Gym & Fitness Equipment Limited, Weston, Canada

[21] Appl. No.: 119,087

[22] Filed: Feb. 6, 1980

[30] Foreign Application Priority Data

Jun. 12, 1979 [CA] Canada ..... 329597

[51] Int. Cl.[3] ..... A63B 21/06

[52] U.S. Cl. ..... 272/118; 272/134

[58] Field of Search ..... 272/118, 117, 116, 134, 272/143

[56] References Cited

U.S. PATENT DOCUMENTS

| | | | |
|---|---|---|---|
| 3,905,599 | 9/1975 | Mazman | 272/118 |
| 3,917,262 | 11/1975 | Salkeld | 272/118 |
| 4,169,589 | 10/1979 | McArthur | 272/118 |

*Primary Examiner*—Richard C. Pinkham

*Assistant Examiner*—William R. Browne

[57] ABSTRACT

The device relates to physical exercise apparatus providing variable resistance to the user has a weight stack movable along a vertical guide and a carriage movable along another guide, the guides being disposed at a predetermined angle to each other and the carriage and the weight stack being connected to each other through a rigid link. The carriage is movable by the user against a variable force dependent on the position of the weight stack in its guide, the angle between the guides and the weight of the stack.

12 Claims, 7 Drawing Figures

WEIGHT LIFTING DEVICE

BACKGROUND OF THE INVENTION

This invention relates to physical exercise apparatus and more particularly to such apparatus as provides a variable resistance to the user.

Apparatus of the present type is generally known but it has not taken into account the different needs of the various parts of the population.

The needs of the physically handicapped or the patient involved in rehabilitative medicine while similar vary enormously from the needs of the professional athlete; the needs of the young adult vary from those of the older adult; and the needs for exercising of legs vary from those for exercising the arms or upper body.

It is generally agreed that the best muscle development may be best accomplished by maximum effort during exercise.

Exercise machines or apparatus should reflect this premise so that the resistance varies according to the muscle set being exercised. For example, in the upper body the load to movement should increase according to the extension of the muscle. However, due to the structure of the leg, apparatus for exercising the leg should reflect the fact that in extending the leg the force capable of being exerted moves from a maximum through a minimum and then increases again. The provision of straight variable resistance in leg exercising can do considerable damage to the leg and the provision of a constant resistance is desirable for maximum benefit.

Various types of commonly termed variable resistance machines have been provided in the prior art. Some of these machines such as exemplified by U.S. Pat. No. 3,708,166 employ pulleys; others such as U.S. Pat. No. 3,905,599 employ levers; and others such as U.S. Pat. No. 3,638,941 employ springs. Pulley and spring mechanisms are more expensive to produce and less reliable in performance. They are also difficult to control from the viewpoint of the user in that the variance in resistance is not as predictable.

More importantly, however, with lever actuated mechanisms such as that described in U.S. Pat. No. 3,905,599 the ratio of the initial lifting weight to the actual stack weight is always greater than 1.

This fact gives rise to two problems: the first is economic in that a greater number of weight blocks have to provide for the initial lift in lever operated mechanisms; and secondly, the heavy initial weight lift frequently makes the equipment unsuitable for rehabilitative applications and for young adults.

SUMMARY OF THE INVENTION

It is the purpose of the present invention to provide variable resistance exercise apparatus which may be employed for exercising the arms and upper body and the lower body and legs and which may be employed by almost the entire population with minimal risk.

In accordance with the present invention an external support frame within which the apparatus is mounted. The operating components of the apparatus comprise essentially a weight stack which is movable up and down a vertical guide; a carriage which is movable up and down an inclined guide track; a rigid link which connects the carriage to the weight stack; and a user arm which is connected to the carriage and which serves to impart motion to the apparatus.

In the case of the shoulder press and bench press embodiments the user arm is a simple bar with handles; in the case of the leg press the user arm is a pair of pivotally linked arms which are guided along an arcuate track.

In the upper body exercising mechanisms the increase in resistance is a function of the angle of inclination of the carriage travel and the angle of inclination of the link. The first is preferably constant for any embodiment; the latter varies throughout the travel.

In the leg press mechanism the variation in resistance is a function of several factors including the angle of inclination of the carriage travel; the link angle; the relative length of the linked arms; and the radius of the guide track.

It will be apparent that with these structures a wide selection of initial lift/final lift ratios may be provided to optimize muscle development depending on the muscle group to be developed and the strength and size of the user.

These features and other advantages of the present invention will be more apparent from the following description and drawings in which specific embodiments are described by way of example.

DESCRIPTION OF THE PREFERRED EMBODIMENTS

It will, of course, be understood that in the following description that good engineering practices would prevail in any physical embodiments and suitable bearings will be provided at any pivot points and the materials and joints therebetween will be of sufficient strength to withstand the rigors of use and abuse.

Figure 1:
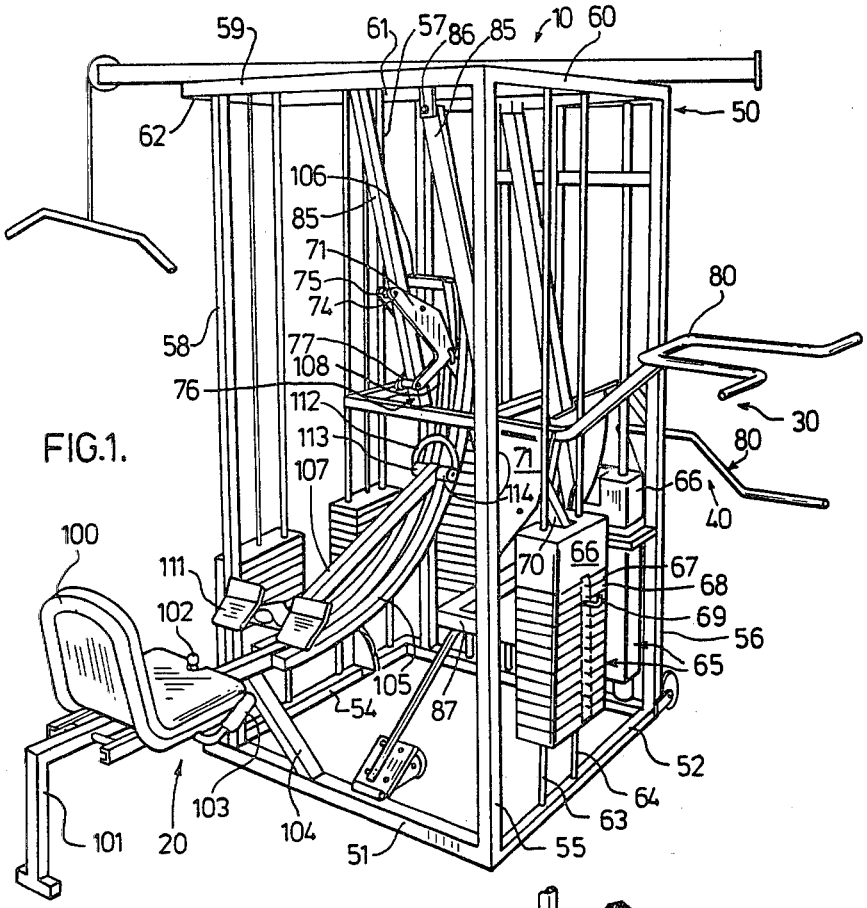
FIG. 1 is a general perspective view from one corner of an exercising apparatus in accordance with the present invention which includes, among other apparatus, a leg press, bench press and shoulder press embodying the present invention.
Figure 2:
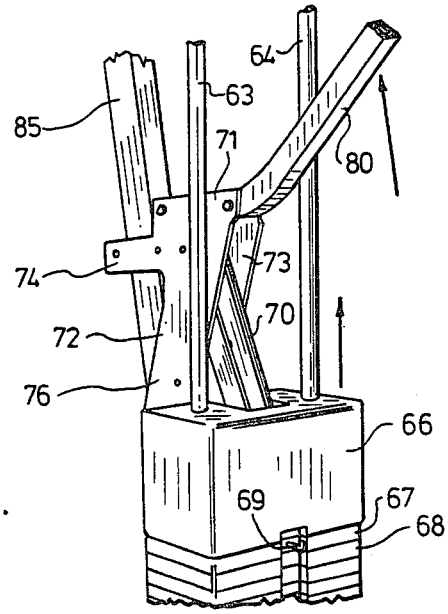
FIG. 2 is an enlarged perspective view of a guide carriage in accordance with the present invention showing its relationship to a weight stack and guide rods.

It will be apparent from the structure illustrated in FIG. 1 that the mechanisms of the present invention permit the accommodation of all the various structures in a single apparatus while providing the advantages of the individual stations.

In FIG. 1 the numeral 10 generally indicates a multistation apparatus incorporating various embodiments of the present invention. These several embodiments are a leg press indicated at 20; a shoulder press 30; and a bench press 40.

A frame 50 provides support for these several mechanisms, however, where individual stations are provided individual frames will be required. Frame 50 has a generally rectangular form with base members 51, 52, 53 and 54 connected by vertical corner members 55, 56, 57 and 58 to upper horizontal members 59, 60, 61 and 62 to provide a rigid rectangular form.

Figure 3:
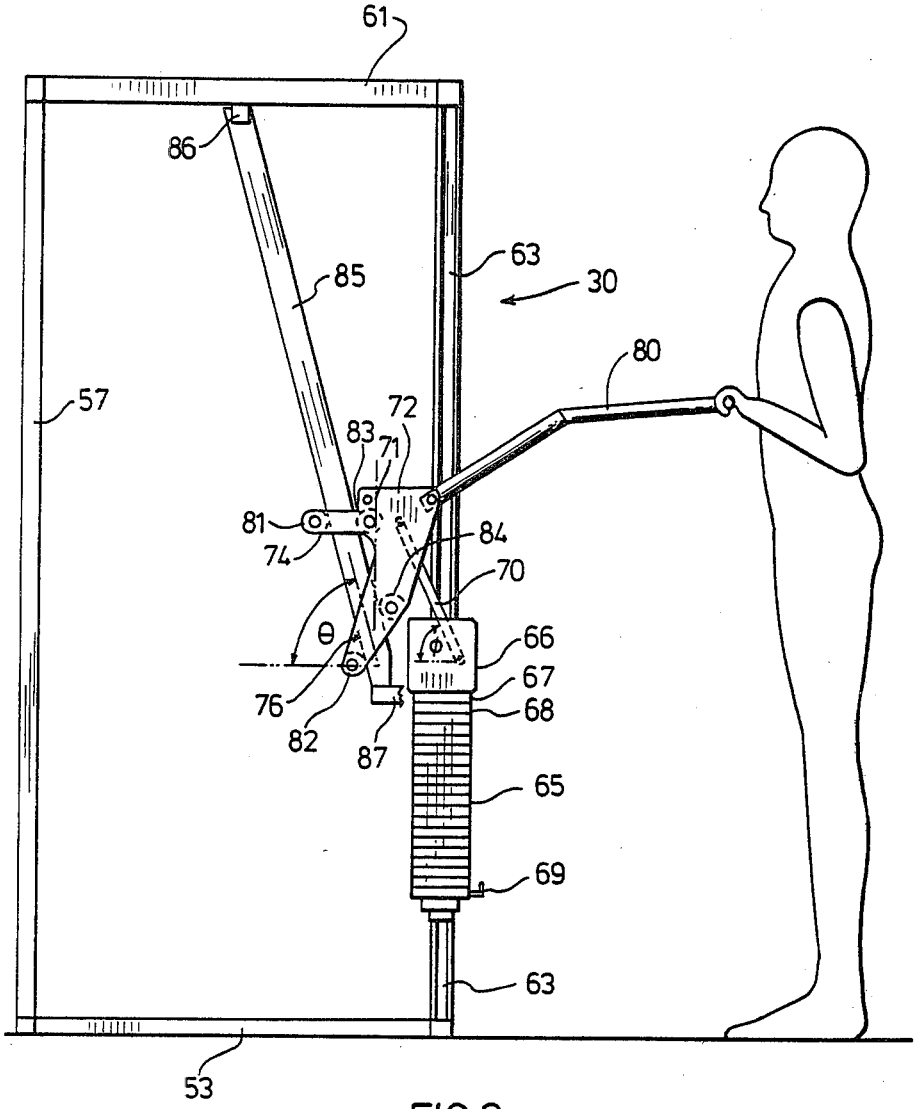
FIG. 3 is a schematic side view of a shoulder press mechanism in accordance with the present invention in an initial lift position.

As shown in schematic partial sections in FIG. 3 a shoulder press 30 in accordance with the present invention comprises a pair of vertical guide rods 63 and 64 the lower ends of which pass through weight stack 65 which is slidably movable thereover. Weight stack 65 comprises an upper minimal weight 66 and a series of individual weights such as 67 and 68 of equal size which may be connected to the minimal weight by a locking pin such as 69 in any suitable manner.

From weight 66 a rigid link 70 extends inward at an angle. Link 70 is pivotally mounted at its lower end to weight 66 and at its upper end to a carriage 71.

Carriage 71 in this embodiment comprises a pair of plates 72 and 73 which have a pair of inwardly extending arms 74 and 75 and a second pair of downwardly extending arms 76 and 77.

To the upper ends of plates 72 and 73 a user arm 80 is rigidly secured. Between plates 72 and 73 bearing rollers 81, 82, 83 and 84 are mounted so that they engage with and bear upon a guide bar in the manner shown in dotted outline in FIG. 3.

The upper end of guide bar 85 is secured tightly in the upper frame as at 86 and the lower end is secured on a bracket 87.

In FIG. 3 a male figure is shown in outline holding on to the user bar 80 with the shoulder press in the initial lift position.

Figure 4:
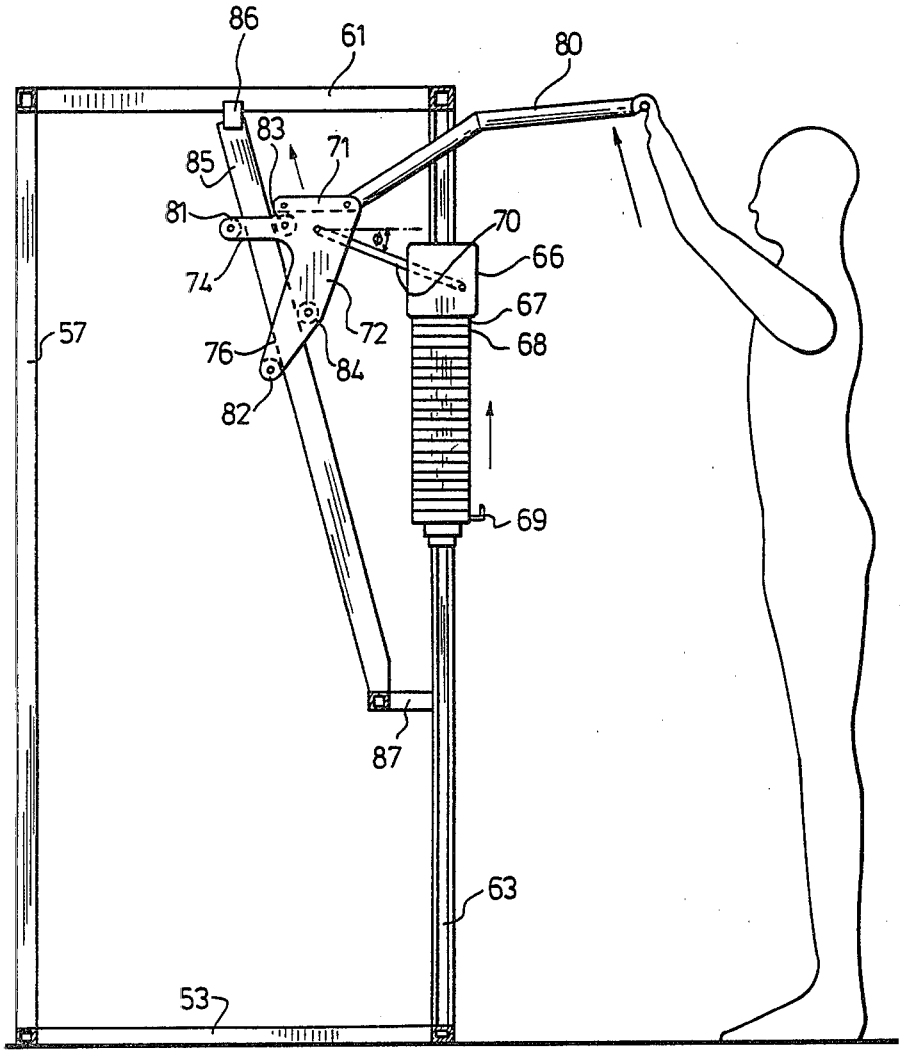
FIG. 4 is a further schematic side view of the shoulder press mechanism illustrated in FIG. 3 in final lift position.

FIG. 4 is a similar view to FIG. 3 and the corresponding parts are correspondingly numbered but the apparatus is shown in the final lift position, i.e. the user has lifted the user bar 80 and the entire weight stack upwards as indicated by the direction of the arrow.

It will, of course, be understood that prior to lifting an initial weight has been selected by the user. In these drawings the entire weight stack has been selected. If a lesser weight is desired a pin such as 69 is inserted to limit the weight to be lifted.

As user arm 80 is lifted carriage 71 moves up guide bar 85. Link 70 pulls up weight stack 65. As carriage 71 moves up link 70 pivots about its mount until at the final lift position it has an attitude such as that illustrated in FIG. 4.

In FIG. 3 the angle of inclination of the guide track 85 to the horizontal is indicated by $\theta$ and the angle of inclination of the link 70 by $\phi$.

In the embodiment illustrated in FIG. 3, $\theta=76$ and $\phi$ initially is equal to 67°. The total vertical travel of the carriage is 27 inches and at the end of the travel the angle $\phi$, the angle defined by the link arm 70 with the horizontal is 27°.

It was determined that the ratios for different weights in the weight stack were as set out in Table I herebelow.

TABLE I

| Initial dead wt. | Initial lift wt. | Final lift wt. | Ratio: initial lift wt./dead wt. | Ratio: final lift/ initial lift |
|---|---|---|---|---|
| lbs. | | | | |
| 45 | 60 | 100 | 1.33 | 1.67 |
| 56 | 68 | 120 | 1.23 | 1.77 |
| 67 | 75 | 140 | 1.12 | 1.87 |
| 78 | 90 | 155 | 1.15 | 1.72 |
| 89 | 105 | 170 | 1.18 | 1.62 |
| 100 | 115 | 185 | 1.15 | 1.61 |

As will be seen from the point of view of efficiency in the use of weights this apparatus permits fewer weights to be used than in a simple lever system. The user is lifting a greater weight than is actually being employed from the initiation of the lift. It will also be observed that the ratio of the final lift/initial lift is enhanced and a variable resistance is provided. The variations in ratio are believed to stem from the normal working of the parts relative to one another.

The bench or chest press although not shown in detail has essentially the same mechanism as the shoulder press but the weights are relatively lower and the user arm 80 is also relatively lower.

In this case, the travel of the carriage 70 is 25 inches. However, the angle of the carriage guide bar 85 and the link 70 are different. In that embodiment, the angle of the carriage $\theta$ is 74.5° and the initial angle of the link 70 is 23. The final angle $\phi$ is 19° at the upper end of the travel.

The ratios for the different weights in the weight stack were as set out in Table II below.

TABLE II

| Initial dead wt. | Initial lift wt. | Ratio: Initial lift wt./ dead wt. | Final lift | Ratio: Final lift wt./ Initial lift wt. |
|---|---|---|---|---|
| 45 | 65 | 1.44 | 80 | 1.23 |
| 56 | 75 | 1.34 | 105 | 1.40 |
| 67 | 85 | 1.27 | 130 | 1.53 |
| 78 | 103 | 1.32 | 155 | 1.50 |
| 89 | 120 | 1.35 | 180 | 1.50 |
| 100 | 130 | 1.30 | 200 | 1.54 |
| 210 | 253 | 1.20 | 415 | 1.6 |
| 221 | 265 | 1.20 | 440 | 1.66 |
| 232 | 283 | 1.22 | 460 | 1.63 |
| 243 | 300 | 1.23 | 480 | 1.60 |
| 254 | 313 | 1.23 | 510 | 1.63 |
| 265 | 325 | 1.23 | 540 | 1.66 |

Again, as will be evident from Table II this system is more efficient with respect to the same considerations as the shoulder press relative to a simple lever system.

The 0–25 inch travel was selected as the optimum suitable travel as 95 percent of the population will have an arm extension in this range. The 27 inch travel may also be modified to 25 inches.

Figure 5:
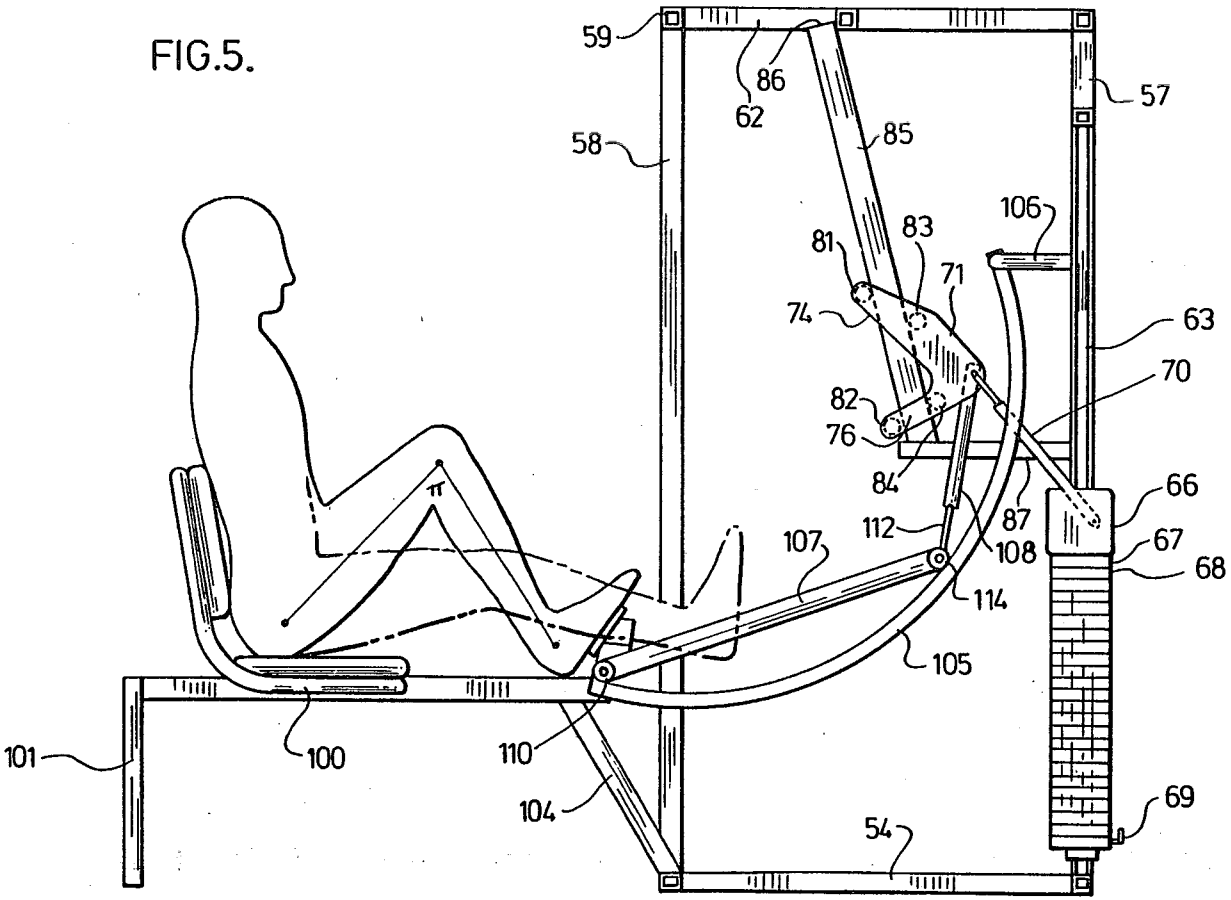
FIG. 5 is a schematic side view of a leg press mechanism embodying the present invention in an initial lift position.
Figure 6:
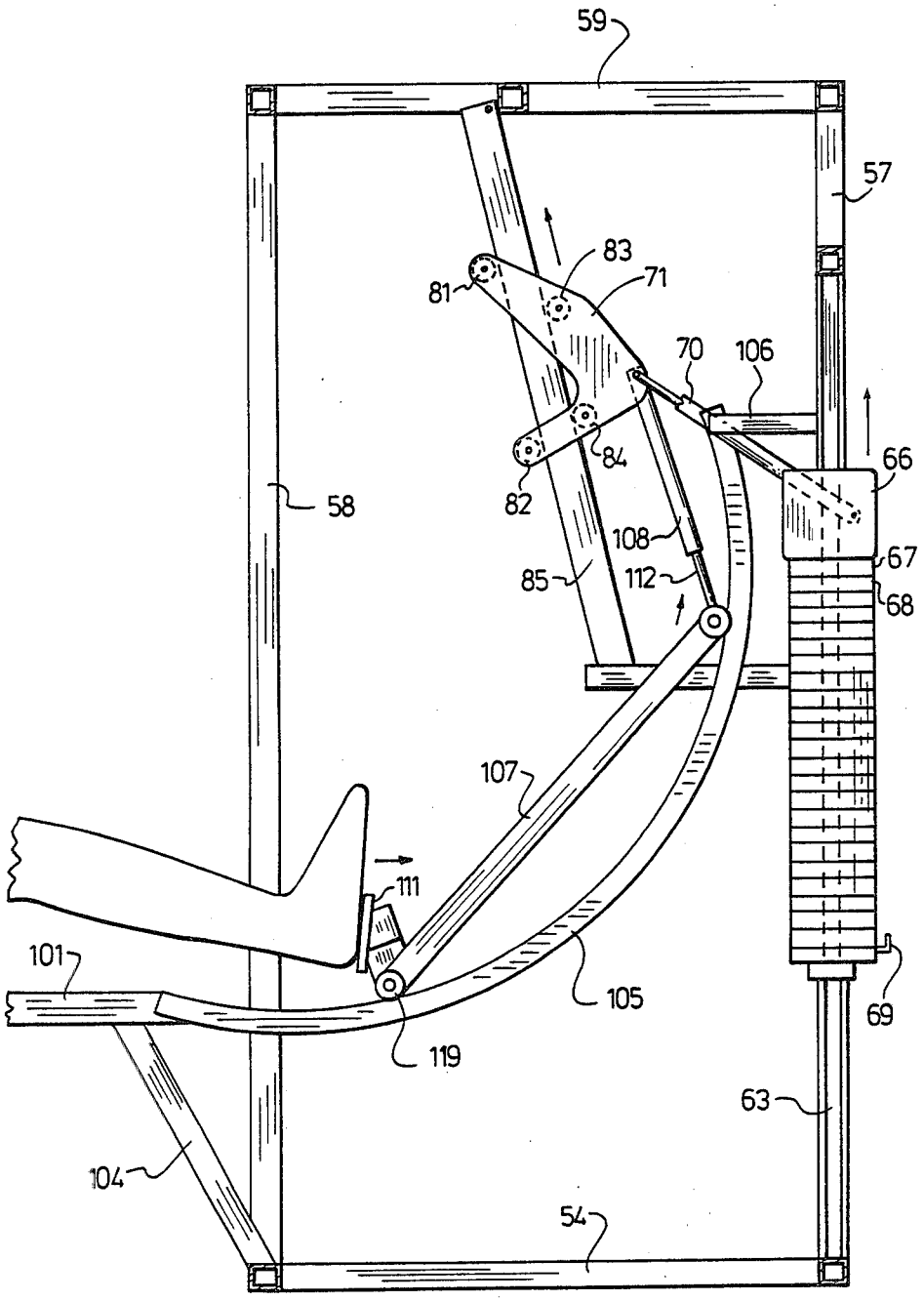
FIG. 6 is a further partial schematic side view of the leg press mechanism of FIG. 5 in a final lift position.
Figure 7:
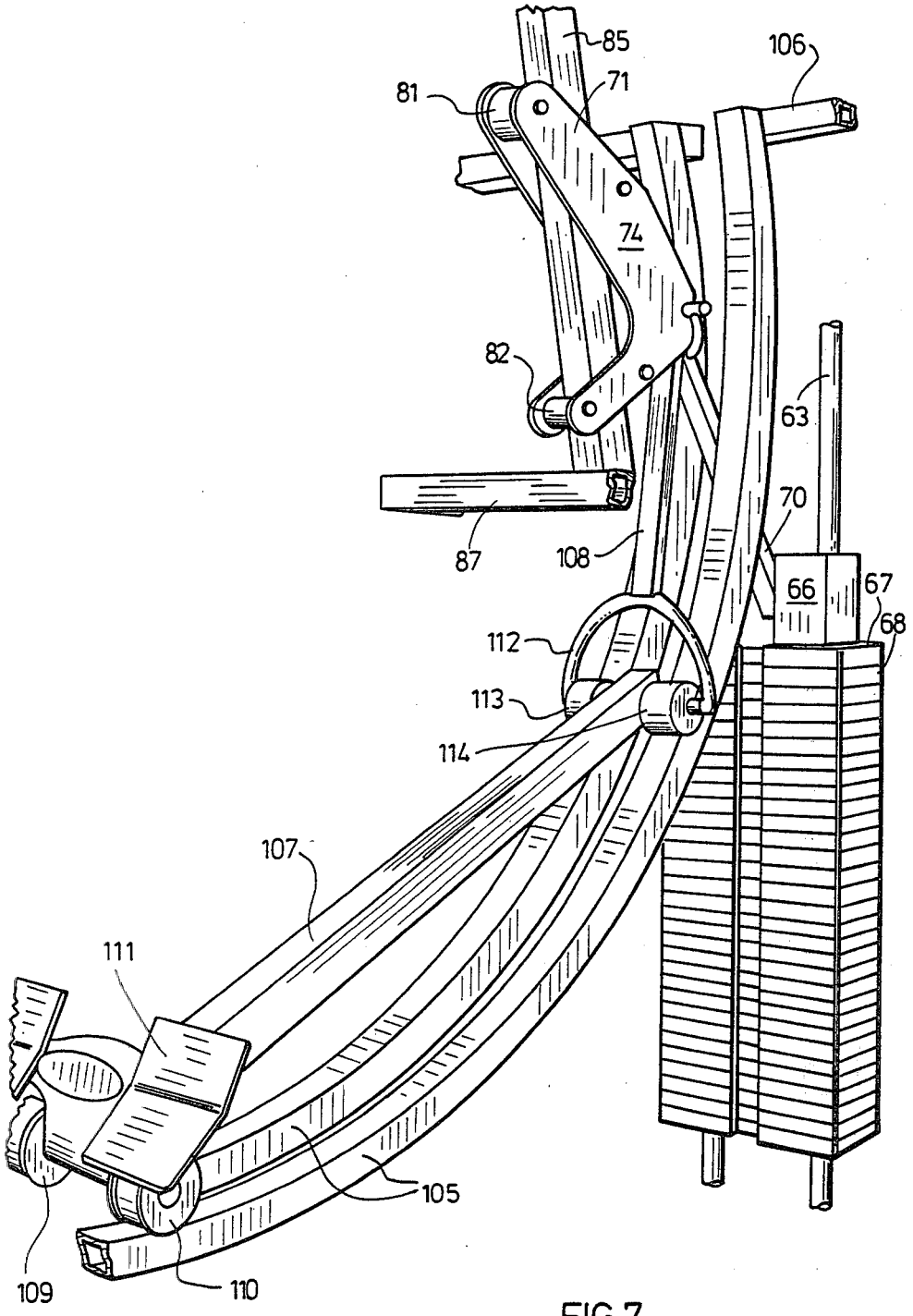
FIG. 7 is an enlarged perspective view of part of the leg press mechanism illustrated in FIGS. 5 and 6 and serves to more clearly illustrate the relationship between the user arm, carriage and weight stack.

It has been found that the relationship between the force applied by the user and the weight selected by the user may be defined as follows:

$H=KW$ where $H$=force exerted by user;

$W$=weight of weight stack; and $$K = 1 + \frac{1}{\tan\theta \cdot \tan\phi}$$

where $\theta$=angle of the guide track 85 to the horizontal and $\phi$=angle of the link 70 to the horizontal The leg press station 20 shown in schematic side view section in FIGS. 5 and 6 and in partial perspective view in FIG. 7 and illustrated in its relationship with the remaining components of the multi-station apparatus in FIG. 1 comprises a seat 100 which is adjustably mounted on the angled bar 101. Seat 100 may be adjusted for the convenience of the user by moving it to the desired position or by pulling up pin 102 and then the bar and then locking it in that position in any manner, e.g. the engagement of a pin on the seat in a selected hole on bar 101. A pair of handles such as 103 are provided on each side of seat 100. Bar 101 is further supported by an angle member 104 which is secured at its lower end to base member 51.

From the inward end of bar 101 a pair of spaced apart arcuate guide tracks 105 extend inwardly. These tracks are secured at their outer ends to bar 101 and at their inner ends to cross bar 106 which is in turn secured to the frame. On tracks 105 a pair of link arms 107 and 108 ride.

Arm 107 at the end adjacent to the user is provided with a pair of rotatably mounted rollers 109 and 110 which ride on tracks 105. Foot plates 111 are also rigidly mounted at this end. At the remote end link arm 107 is pivotally connected to arm 108 by a bracket 112. A second pair of rollers 113 and 114 which again ride on tracks 105 are rotatably mounted at the remote end of link arm 107. The upper or inner end of arm 108 is pivotally connected to a bracket 71 of the same construction as that previously described with respect to the embodiment illustrated in FIGS. 3 and 4.

Again, a link 70 connects bracket 71 to the weight stack 65 and again this connection is pivotal to permit link 70 to change its attitude relative to the weight stack and the carriage. In this embodiment the operation is accomplished by the user sitting in the seat 100 with feet engaged with the foot pedals 111. It is assumed that the weight has been previously selected.

The user then pushes the foot pedals so that the links 107 and 108 urge the carriage 70 up the guide track 85 as the legs are extended to reach the position shown in FIG. 6. Again, the foot pedal travel is 25 inches.

In FIG. 5, the angle of the leg is defined for the purposes of this specification as $\pi$. It has been found that when $\pi$ approaches 60° there is a decrease in the force applied by the legs.

In the embodiment of FIGS. 5 and 6 it will be observed that tracks 105 are mounted such that there is an initial downward thrust. The result of the movement of the pedals, carriage and the weight is shown in the following Table III.

TABLE III

| Travel | Initial dead wt. | Initial lift wt. | Ratio |
|---|---|---|---|
| 0.000 | 50 lbs. | 59.07 | 1.181 |
| 1.419 | 50 | 56.58 | 1.132 |
| 2.856 | 50 | 54.87 | 1.098 |
| 4.306 | 50 | 53.80 | 1.076 |
| 5.765 | 50 | 53.28 | 1.066 |
| 7.229 | 50 | 53.24 | 1.065 |
| 8.695 | 50 | 53.66 | 1.073 |
| 10.158 | 50 | 54.52 | 1.090 |
| 11.615 | 50 | 55.81 | 1.116 |
| 13.060 | 50 | 57.53 | 1.151 |
| 14.492 | 50 | 59.72 | 1.194 |
| 15.904 | 50 | 62.39 | 1.248 |
| 17.294 | 50 | 65.61 | 1.312 |
| 18.658 | 50 | 69.45 | 1.389 |
| 19.992 | 50 | 74.01 | 1.480 |

TABLE III-continued

| Travel | Initial dead wt. | Initial lift wt. | Ratio |
|---|---|---|---|
| 21.293 | 50 | 79.50 | 1.590 |
| 22.556 | 50 | 86.23 | 1.725 |
| 23.778 | 50 | 94.79 | 1.896 |
| 24.956 | 50 | 106.53 | 2.131 |

From the foregoing table, it will be seen that the initial 50 lbs. dead weight requires a force of approximately 60 lbs. to move it and this decreases at 5.7 inches to 53.24 lbs. and then increases to 106.531 lbs. at the end of the 25 inch travel.

These variations are substantially coincidental with the change in leg strength as the angle of the leg changes in the forward movement.

More generally, the force required is a function of the angles of the several links.

From the foregoing description it will be seen that variable resistance apparatus has been provided that is more economical and efficient to operate. There is a reduced requirement for the provision of weights in view of the fact that the dead weight is the actual weight always requires a greater force than the actual weight to effect movement and when moved there is an increase in the effort required to effect movement.

The ratios of final weight to initial weight have been chosen to provide a range for most potential users. It will, of course, be apparent that by varying the angles of the linkages and the guide tracks that other ratios may be obtained within the same equipment.

It should also be noted that the structures provided having obviated levers may be more easily accommodated in multi-station apparatus. It will also be apparent that these machines may be employed as single station machines without deviating from the embodiments illustrated.

The user arms or handles 80 may also be mounted on the carriages in various positions to accommodate different sizes of people.

While the present invention has been described with respect to several specific embodiments other modifications and changes will be obvious to those skilled in the art and may be made without departing from the spirit and scope of the invention as defined in the appended claims.

The embodiments of the invention in which an exclusive property or privilege is claimed are defined as follows:

1. Weight training apparatus comprising:

a vertical guide;

a weight stack engaged with and reciprocally movable along said vertical guide;

a second guide inclined at a predetermined angle to said vertical guide;

said second guide extending upwardly in a direction inclined away from said vertical guide;

a carriage reciprocally movable along said second guide;

means for moving said carriage along said second guide; and a rigid link means pivotally connected to said weight stack and to said carriage so that movement of the carriage along said second guide will cause said weight stack to be lifted;

said rigid link extending upwardly in a direction inclined away from said vertical guide.

2. A weight training device as claimed in claim 1 in which the weight stack comprises an upper weight and a series of individual weights connectable additively to the upper weight.

3. A weight training device as claimed in claim 1 in which said carriage is movable along said second guide on rollers.

4. A weight training device as claimed in claim 3 in which said second guide is a bar and said carriage includes two pairs of arms, the arms of each pair extending one to each side of said guide bar and the arms of each pair supporting between them rollers movable along said guide bar.

5. Apparatus as claimed in claim 1 in which:

H=KW wherein:

H=the force applied by the user;

W=the weight of the weight stack; and $$K = 1 + \frac{1}{\tan\theta \cdot \tan\phi}$$

where $\theta$=angle of inclination of said second guide means; and $\phi$=angle of inclination of said rigid link connecting said weight stack and said carriage.

6. Apparatus as claimed in claim 1 wherein said means for moving said carriage includes first and second links pivotally connected one to the other, said first link having a free end and a foot pedal mounted thereon; said second link being further pivotally connected to said carriage, and third guide means for determining the path of travel of said first and second links.

7. Apparatus as claimed in claim 6 wherein said third guide means is arcuate.

8. Apparatus as claimed in claim 6 wherein an angle defined by said second link of said user arm and said rigid link means is variable; and a force required by a user varies increasingly in response to upward movement of said weight stack.

9. A weight training device comprising:

a vertical guide;

a weight stack engaged with and reciprocally movable along said vertical guide;

a second guide inclined at a predetermined angle to said vertical guide;

said second guide extending upwardly in a direction inclined away from said vertical guide;

a carriage reciprocally movable along said second guide;

a rigid link means pivotally connected to said weight stack and to said second carriage so that movement of the carriage along said second guide will cause said weight stack to be lifted;

said rigid link extending upwardly in a direction inclined away from said vertical guide; and a user arm connected to said carriage for moving said carriage along said second guide, the user arm including first and second links pivotally connected one to the other, said first link having a free end and a foot pedal mounted thereon; said second link being further pivotally connected to said carriage, and third guide means for determining the path of travel of said first and second links.

10. Apparatus as claimed in claim 9 wherein said third guide means is arcuate.

11. Apparatus as claimed in claim 9 in which:

H=KW wherein:

H=the force applied by the user;

W=the weight of the weight stack; and $$K = 1 + \frac{1}{\tan\theta \cdot \tan\phi}$$

where $\theta$=angle of inclination of said second guide means; and $\phi$=angle of inclination of said rigid link connecting said weight stack and said carriage.

12. Apparatus as claimed in claim 9 wherein an angle defined by said second link of said user arm and said rigid link means is variable; and a force required by a user varies increasingly in response to upward movement of said weight stack.

* * * * *